US007510189B2

(12) United States Patent
Carlson et al.

(10) Patent No.: US 7,510,189 B2
(45) Date of Patent: Mar. 31, 2009

(54) METHOD OF PLAYING DO OR DIE GAME

(76) Inventors: Kenneth Carlson, 11 Deer Ridge, Stonibgton, CT (US) 06378; Kimberly Carlson, 11 Deer Ridge, Stonington, CT (US) 06378; Wayne Lecardo, 1-N Lakeside Dr., Ledyard, CT (US) 06339; Stein Katherine, 1-N Lakeside Dr., Ledyard, CT (US) 06339

( * ) Notice: Subject to any disclaimer, the term of this patent is extended or adjusted under 35 U.S.C. 154(b) by 0 days.

(21) Appl. No.: 11/653,524

(22) Filed: Jan. 16, 2007

(65) Prior Publication Data

US 2007/0200294 A1 Aug. 30, 2007

Related U.S. Application Data

(62) Division of application No. 11/034,434, filed on Jan. 11, 2005, now abandoned.

(51) Int. Cl.
*A63F 3/00* (2006.01)

(52) U.S. Cl. ..... 273/243; 273/248

(58) Field of Classification Search ..... 273/243, 273/248

See application file for complete search history.

(56) References Cited

U.S. PATENT DOCUMENTS 4,273,337 A * 6/1981 Carrera et al. ..... 273/243
5,292,133 A * 3/1994 Alexander ..... 273/256
6,547,245 B1 * 4/2003 Olutunfese ..... 273/248
7,198,271 B1 * 4/2007 Thomas ..... 273/272

* cited by examiner

*Primary Examiner*—Vishi K. Mendiratta

(57) ABSTRACT

A game apparatus and method is provided comprising a a game board having a circular rotating base with a top surface having a raised outer track defined by a linear progression of playing spaces. Said track having a start/finish playing space defining a closed-loop movement track. Said playing spaces further having a color indicia inscribed thereon alternately disposed along said track. Said color indicia defining a required course of action necessary for advancement along said track. The game device also includes a first and second deck of directive action cards corresponding to said color indicia of said playing spaces. Some or all of the first deck of directive action cards are determined by each player prior to commencement of the game and may be changed during the course of the game. Said second deck of directive action cards includes a plurality of cards causing rearranging with other movement pieces. A movement piece is assigned to each player. The game proceeds with sequential player turns and movement along said track is determined by a random number from a random number selector. Said movement piece may encounter interfacing with other movement pieces which will result in rearranging of said movement pieces. The completion of a task as inscribed on said first and second deck of directive action cards entitles said player to continue. Failure to complete said task terminates said player's turn and causes backward movement along said track by a random number value obtained by a random number selector. A winner is declared by the player that first reaches said start/finish playing space and a prize is awarded as pre-determined and recorded on a contract pad.

14 Claims, 3 Drawing Sheets

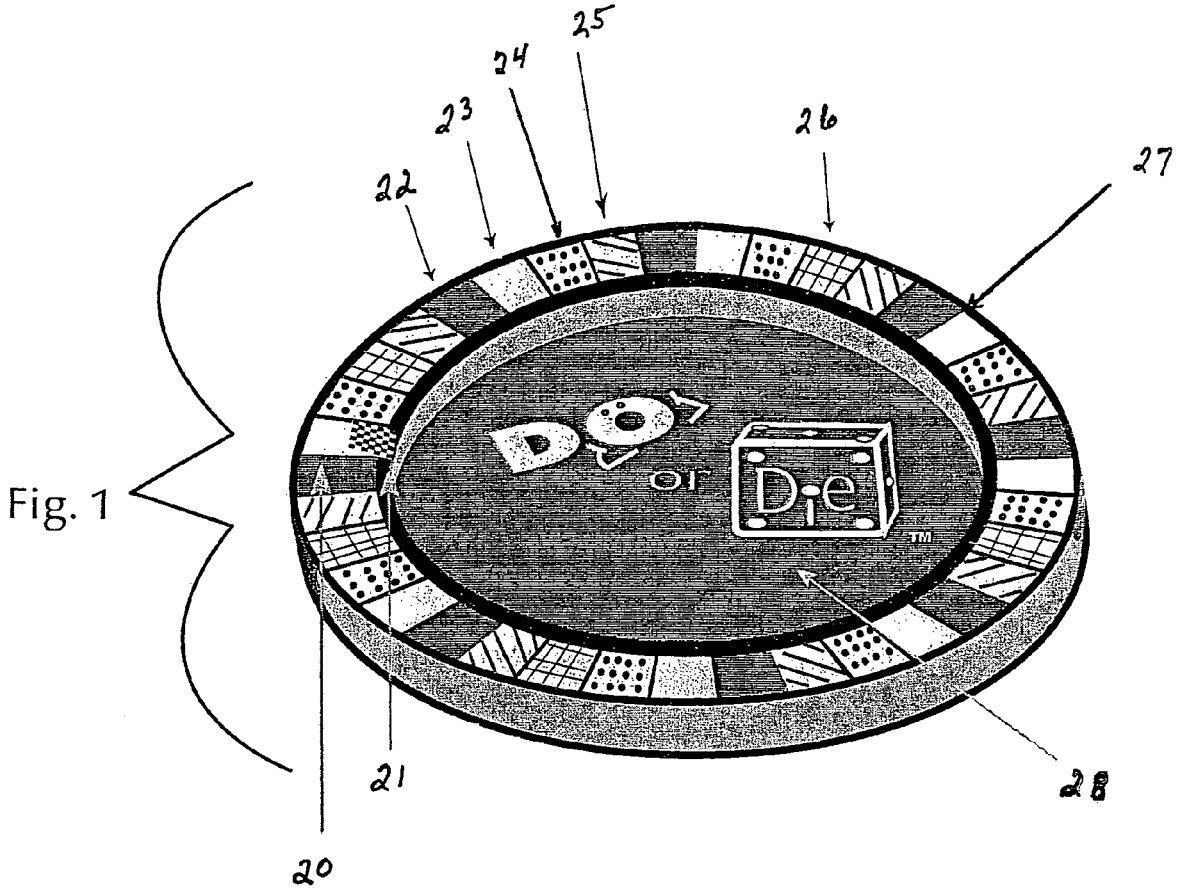
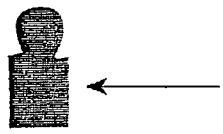
Fig. 2

METHOD OF PLAYING DO OR DIE GAME

CROSS-REFERENCE

The present application is a divisional application required by restriction requirement of application Ser. No. 11/034,434 filed Jan. 11, 2005 now abn., entitled "Do or Die" by inventors, Kenneth Carlson, Kimberly Carlson, Wayne Lecardo and Katherine Stein.

STATEMENT REGARDING FEDERALLY SPONSORED RESEARCH OR DEVELOPMENT

Not Applicable

REFERENCE TO MICROFICHE APPENDIX

Not Applicable

BACKGROUND OF THE INVENTION AND PRIOR ART

The present invention relates in general to board games and game apparatuses, more particularly to those involving movement along a defined track determined by chance and successful completion of a task.

Unknown is any prior art which contains an expression of ingenuity, personality, creativity and other individual characteristics of each player forming the tenor of each game.

It is therefore an objective of this invention to provide an entertaining and competitive game combining chance with ingenuity, imagination and creativity of the players.

It is further an objective of the present game to provide a new board suitable for play for all age groups of players.

It is further an objective of the present game to provide a new board game that is educational for children, developing imagination and creativity skills of said children along with the opportunity to express their personal notions and still be entertaining.

It is further an object of this invention is to provide a game in which the tenor of the game varies with each game played and the individual players.

It is another object of the present invention to provide a new board game efficiently manufactured and of a durable and reliable construction.

It is still another object of the present invention to provide a new and improved board game which is susceptible of a low cost of manufacturing with regard to both material and labor, and which accordingly is then susceptible of a low price of sale to the consuming public, thereby making such board games available to the buying public.

BRIEF SUMMARY

The present invention is directed to a game apparatus and game method that is entertaining and allows for individual expression of personality, ingenuity, creativity and competitiveness.

The general purpose of the present invention is to provide a new game apparatus and game method having many novel features not anticipated, or implied in the prior art.

The present invention provides a circular rotating game board comprised of a raised outer track. The raised outer track includes a linear progression of playing spaces having a start/finish playing space defining a closed-loop movement track. The playing spaces each have a color indicia inscribed thereon and are alternately disposed along the outer track.

The colored indicia determine what action a player must successfully complete to continue advancing along the movement track. The colored indicia further correspond to a first and second deck of directive action cards. Some or all of the first deck of cards are created by each player and may be changed during the game. Each player is assigned a playing piece. The object of the game is for the first player to reach the finish playing space and is accomplished by rolling a die, moving the player's playing piece a number of spaces equal to the value on the die, performing the required action corresponding to the color indicia including selecting a card from the first or second deck of directive action cards and completing the task inscribed thereon. The declared winner is awarded a prize that was pre-determined and agreed upon by each player and recorded on a prize contract pad prior to commencing the game.

Other features of the present invention will become apparent in the following description taken in conjunction with the following drawings. It is to be understood that the foregoing general description and the following detailed description are exemplary and explanatory but are not restrictive of the invention.

BRIEF DESCRIPTION OF THE DRAWINGS

The accompany drawings which are incorporated in and constitute a part of this invention, illustrate one of the embodiments of the invention, and together with the description, serve to explain the principles of the invention in general terms. Like numerals refer to like parts throughout the disclosure.

These and other features, aspects, and advantages of the present invention will become better understood with regard to the following description, appended claims, and accompanying drawings where:

FIG. 1 is a schematic plan view of the layout of the game board.

FIG. 2 is a schematic plan view of a playing piece.

DESCRIPTION OF THE PREFERRED EMBODIMENT

Figure 13:
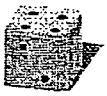
FIG. 13 is a schematic perspective view of a die.
Figure 15:
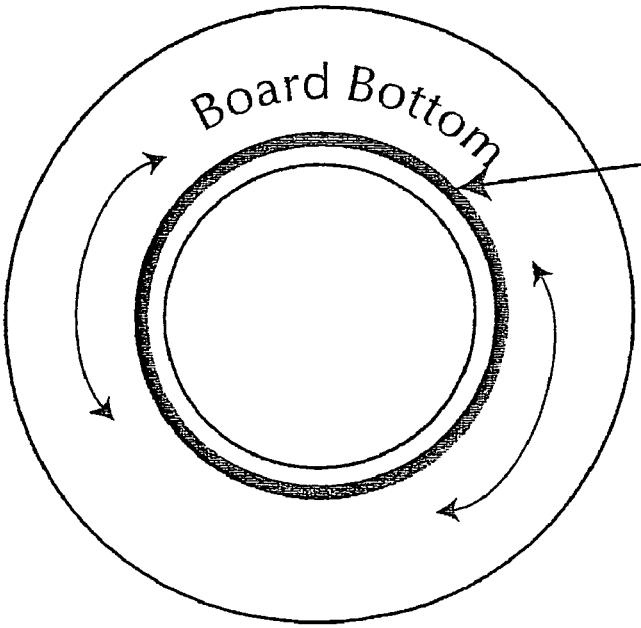
FIG. 15 is a side view of the swivel means on the base of the game board.

With reference to the drawings, more particularly to FIGS. 1 through 16 thereof, a new Do or Die game apparatus and game method generally comprises a circular rotating game board illustrated in FIG. 1 having a raised outer track (27) and a inner center open pit (28). The outer track (27) further comprising a linear progression of playing spaces having a color indicia inscribed thereon (22, 23, 24, 25, 26). Said playing spaces being alternately disposed along the outer track (27) defining a closed-loop movement track. Said track further containing a start/finish playing space (20). The start/finish space (20) being red in color and designated by a flag (21) being positioned on said outer track (27). Each player is assigned a playing piece illustrated in FIG. 2 for movement along said outer track (27). Each player commences the game on the start/finish space (20). A plurality of sequential player turns are performed comprising rolling of a die illustrated in FIG. 13 into the center open pit (28), moving said player piece (FIG. 2) a corresponding value of playing spaces on the outer track (27) and completing a task determined by said color indicia inscribed on said playing space (22, 23, 24, 25, 26) in which the player lands on. The player to advance first on the start/finish space (20) after successful movement about said tract (27) is declared a winner and is awarded a prize, said prize pre-determined by each player and recorded on prize contract illustrated in FIG. 9.

The Do or Die game apparatus and game method is designed for at least two players of any ages and may be played with teams of players.

Figure 3:
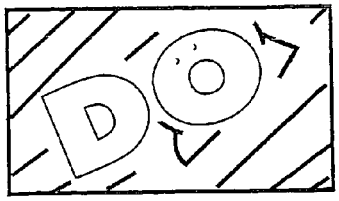
FIG. 3 is a schematic plan view of the front side of a blue "DO" card.
Figure 4:
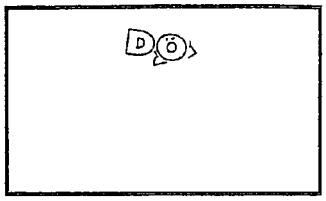
FIG. 4 is a schematic plan view of a back side of a blank blue "DO" card.
Figure 5:
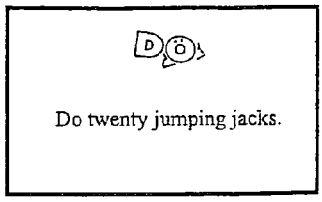
FIG. 5 is a schematic plan view of a blue "DO" card illustrating pre-printed task.
Figure 6:
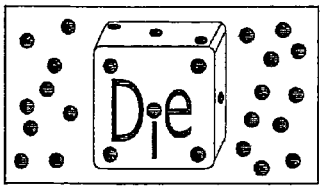
FIG. 6 is a schematic plan view of a front side of a yellow "DIE" card.
Figure 7:
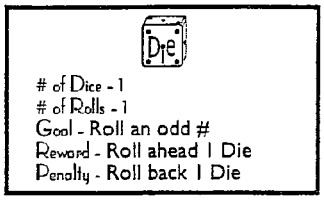
FIG. 7 is a schematic plan view back side of a yellow "DIE" card illustrating sets of die instructions.
Figure 8:
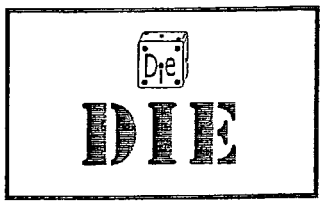
FIG. 8 is a schematic plan view of a back side of a yellow "DIE" card illustrating the word "DIE".
Figure 9:
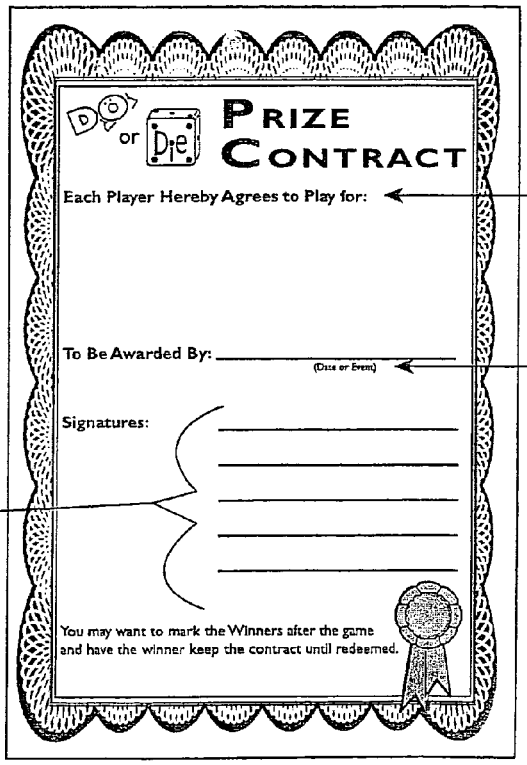
FIG. 9 is a schematic plan view of a prize contract.
Figure 10:
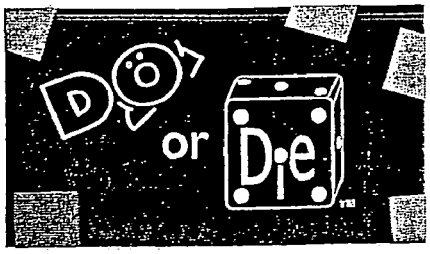
FIG. 10 is a schematic plan view of the front side of a color key card.

Also provided in said game is a plurality of directive action cards referred to a "DO" card, illustrated in FIG. 3 and a "DIE" card, illustrated in FIG. 6. Said "DO" cards being blue in color having inscribed thereon pre-printed tasks illustrated in FIG. 5 to be completed by said player piece FIG. 2 that advances on the corresponding blue spaces (25). Said "DO" cards further consisting of a plurality of blank cards, illustrated in FIG. 4, permitting for each said player to inscribe thereon a directive action with pencil, shown in FIG. 11, prior to playing said game and changeable during play using a erasure, shown in FIG. 12. The "DIE" cards (FIG. 6) being yellow in color having inscribed thereon pre-printed tasks (FIG. 7) to be completed by said player piece (FIG. 2) that advances on the corresponding yellow playing spaces (24) on tract (27). The "DIE" card tasks (FIG. 7) defining: a goal to be achieved; a first number indicating the die (FIG. 13) or plurality of die to be rolled to obtain said goal; a second number defining the number of rolls permitted to obtain said goal; and, a third number defining the amount of playing spaces to advance if successful completion of said required "DIE" card tasks (FIG. 7) or said number of spaces to move backwards on tract (27) for failure to achieve said goal. The "DIE" cards (FIG. 6) further comprising a plurality of cards having the inscription "DIE" thereon (FIG. 8). A player picking said card (FIG. 8) is required to trade playing spaces with the player positioned in last place on the tract (27).

The player advancing on a playing space having a red color indicia (22) on the tract (27) terminates his/her turn. The player advancing on a playing space having a green color indicia (26) on tract (27) is required to roll said die (FIG. 13) again. The player advancing on a playing space having a orange color indicia (23) is required to pick from either the "DIE" cards (FIG. 7) or the "DO" cards (FIG. 3) and complete the respective inscribed tasks to move forward on the tract (27) towards the start/finish space (20).

Figure 16:
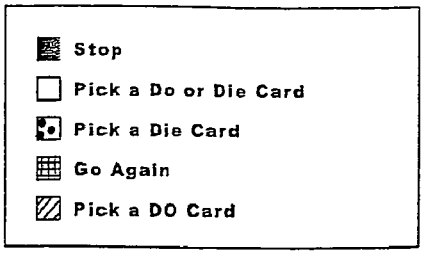
FIG. 16 is a schematic plan view of the back side of a color key card.
Figure 11:
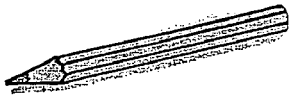
FIG. 11 is a schematic perspective view of a pencil.
Figure 12:
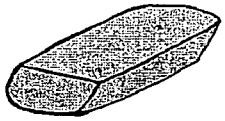
FIG. 12 is a schematic perspective view of a die.

A plurality of color key cards, illustrated in FIG. 16, (10) are provided to indicate the player or players required action of the corresponding color playing spaces as detailed above dependent on the color indicia of the playing spaces landed on as the player moves toward the start/finish space (20).

The player that advances designated the start/finish space (20) is awarded the prize (30) and date of delivery agreed to by each player and recorded on prize contract (9). The prize (30) is recorded on a prize contract, shown in FIG. 9 agreed by each player (32) and including a date of delivery (31).

Below are further details and specifics of this Do or Die game:

OBJECT OF THE GAME: The object of the game is the first player to roll exactly onto the last playing space designated with the flag marker is declared the winner PLAYERS: For two or more players of all ages or teams of players THE GAME: The game board itself is made of a suitable material of a sturdy construction such as plastic or wood and generally a circular shape with a rotating mechanism (15) for ease of access by each player. The game board further having a open center pit for rolling of said die.

THE CONTENTS: The game board consists of at least thirty-seven colored playing spaces, at least eight red colored playing spaces, at least eight orange colored playing spaces, at least eight yellow colored playing spaces, at least five green colored playing spaces, and at least eight blue colored spaces. A checkered flag is positioned on a red colored space designating said start/finish playing space. Each player receiving a distinctive playing piece. The game further consisting of at least a total of seventy blue colored "DO" cards. Of the said seventy blue colored "DO" cards, at least fifty of said cards being blank for each player to inscribe a directive task thereon prior to commencement of the game. The game further consisting of a total of eighty yellow "DIE" cards. Of the said eighty yellow cards, at least Seventy-six of said cards having inscribed thereon the following instructions tasks: plurality of die or single die to be rolled to obtain a goal; a number of rolls to achieve a the goal, a goal consisting of a number or die combinations; and, moving the playing piece forward or backwards on the game tract depending for on achieving or failure to achieve the goal. The goal comprising a number or combination of die indicated on the "DIE" card selected by the player. Further included in the game is prize contracts (FIG. 9) for recording the agreed upon prize. (30) A plurality of color key cards are contained within indicating the action associated with each color playing space as the players' move onto said spaces. At least five die to be to be rolled to determine the players' movement around the game board and also to be rolled to complete die combinations as inscribed on the "DIE" cards. Finally, a pencil (FIG. 11) and a erasure (FIG. 12) will be provided to individual players to use in completing the prize contract (FIG. 9) and inscribing or changing individual instructions tasks on the "DO" cards. The prize contract awarded to the first player to reach the checkered flag (FIG. 14) positioned on the game tract (21).

Although novel features of this invention have been shown and described and are pointed out in the annexed claims, it is not intended to be limited or restricted to the details above, since it will be understood that various omissions, modifications, substitutions, and changes in the forms or details of the game apparatus and its operation can be made by those skilled in the art without departing in any way from the spirit of the present invention.

The invention claimed is:

1. A method for playing a board game having a game apparatus with a circular closed-loop movement path consisting of a linear sequence of playing spaces having a plurality of color indicia inscribed thereon and alternately situated along the movement path, the method comprising the steps of:

(a) providing a start/finish space within the movement path marking a beginning position and a terminal position for starting and ending said board game;

(b) providing a plurality of playing spaces having a color inscribed thereon selected from a group of colors consisting of blue, yellow, orange, red or green, said playing spaces alternately arranged along the closed-loop movement tract;

(c) providing a plurality of playing pieces, said playing piece used by a player to mark the player's position along the movement path;

(d) providing a random number selector for obtaining a first number determining a sequence of player turns, said player obtaining the highest number commences the game;

(e) providing a plurality of first deck cards having a task inscribed thereon, said first deck cards further comprising a plurality of cards having inscribed tasks originated by each said player;

(f) providing a plurality of second deck cards, said deck cards further having inscribed thereon: a goal, said goal being a combination of die; a second number indicating said player's attempts to achieve said goal; and, a third number indicating the corresponding playing spaces said player advances or retracts along the movement tract depending on achieving said goal;

(g) providing a plurality of contract cards, each said card comprising a contract recording sheet for documentation of a prize and condition for declaring a winner player agreed to by all said players;

(h) performing a plurality of the sequential player turns comprising the steps of:

(1) obtaining a fourth number from the random number selector;

(2) moving the playing piece along the movement path a corresponding amount of playing spaces;

(3) selecting a card from said plurality of first deck of cards or from said plurality of second deck of cards determined by said color indicia of the playing space;

(4) performing the task inscribed on said first deck cards or attempting to achieve the goal indicated on said second deck cards;

(5) retracting said playing piece a corresponding amount of spaces along the movement tract determined by a fifth number obtained from the random number selector for failing to complete said task or achieve said goal;

(6) advancing said playing piece towards said terminal position the corresponding number of spaces equal to said fifth number by completion of said directive task or achieving said goal;

(7) terminating said player turn comprising the steps of:

moving the playing piece on the playing space of said color indicia designated for terminating said players turn;

selecting said card from said first or second deck of cards having inscribed thereon directions to terminate play;

failing to complete the task inscribed on said first deck cards;

and, failing to achieve the goal inscribed on said second deck cards;

(i) designating a winning player by moving said playing piece completely around said movement tract to said starting/finish playing space; and, (j) awarding said winning player a prize documented on said contract sheet.

2. The method of playing a board game of claim 1, wherein said plurality of players comprises of at least two players or combination of players.

3. The method of playing a board game of claim 1, wherein the linear sequence of playing spaces on said movement tract having inscribed thereon a color consisting of blue, yellow, orange, red or green and alternately arranged along said movement path.

4. The method of playing a board game of claim 1, wherein the first deck of cards are blue in color and designated as "Do" cards.

5. The method of playing a board game of claim 1, wherein the second deck cards are yellow in color and designated as "Die" cards.

6. The method of playing a board game of claim 5, in which the said "Die" cards further contain a plurality of cards having inscribed thereon a directive to switch positions with said player positioned last on said movement tract.

7. The method of playing a board game of claim 1, wherein advancing on said playing space red in color terminates said player's turn.

8. The method of playing a board game of claim 1, wherein advancing on said playing space blue in color designates said player to select from said first deck cards.

9. The method of playing a board game of claim 1, wherein advancing on said playing space yellow in color designates said player select from said second deck cards.

10. The method of playing a board game of claim 1, wherein the random selector means comprises tossing a die or plurality of die having a six sided shape, each said side having a number inscribed thereon or a spot or plurality of spots corresponding to a number value.

11. The method of playing a board game of claim 1, wherein advancing on said playing space orange in color designates said player's choice to select from either the first deck cards or second deck cards.

12. The method of playing a board game of claim 1, wherein advancing on said playing space green in color designates said player to repeat said playing turn.

13. The method of playing a board game of claim 1, wherein the player first to advance completely along said movement tract and landing on the designated start/finish space is the winner.

14. The method of playing a board game of claim 1, wherein the declared winner is given said contract designating the prize determined by the players at the commencement of said game.

* * * * *